US007320623B2

(12) United States Patent
Hisamatsu et al.

(10) Patent No.: US 7,320,623 B2
(45) Date of Patent: Jan. 22, 2008

(54) CONNECTOR WITH PROTECTION AGAINST ELECTROSTATIC CHARGES ACCUMULATED ON A MATING CONNECTOR

(75) Inventors: Kazuhito Hisamatsu, Tokyo (JP); Kazukuni Hisatomi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/634,549

(22) Filed: Dec. 6, 2006

(65) Prior Publication Data

US 2007/0128946 A1 Jun. 7, 2007

(30) Foreign Application Priority Data

Dec. 6, 2005 (JP) ..... 2005-352120

(51) Int. Cl.
*H01R 24/00* (2006.01)

(52) U.S. Cl. ..... 439/637; 439/607; 439/108

(58) Field of Classification Search ..... 439/638, 439/607, 108, 637
See application file for complete search history.

(56) References Cited

U.S. PATENT DOCUMENTS 3,587,029 A * 6/1971 Knowles ..... 439/607
5,004,427 A * 4/1991 Lindeman ..... 439/101
6,193,552 B1 * 2/2001 Chiou et al. ..... 439/607
6,315,616 B1 * 11/2001 Hayashi ..... 439/638
6,659,791 B1 * 12/2003 Ko et al. ..... 439/353
6,749,463 B1 * 6/2004 Fan ..... 439/607
D497,596 S * 10/2004 Hisamatsu et al. ..... D13/147
7,029,330 B1 * 4/2006 Ro ..... 439/607

FOREIGN PATENT DOCUMENTS

JP 11-283710 10/1999
JP 2002-042995 2/2002
JP 2003-007408 1/2003

* cited by examiner

*Primary Examiner*—Renee Luebke
*Assistant Examiner*—Harshad C Patel
(74) *Attorney, Agent, or Firm*—Collard & Roe, P.C.

(57) ABSTRACT

In a connector including a fitting portion to be fitted to a mating connector, signal contacts are disposed in the fitting portion in a first row. A ground plate includes a plurality of ground terminals disposed in the fitting portion in a second row parallel to the first row. These contacts are held by a housing. A conductive shell is coupled to the housing and includes a shell body partially covering these contacts, a bent portion bent inward from the shell body at an end of the fitting portion, and a protecting portion extending from the bent portion with a space which is kept between the protecting portion and the shell body. Each of the ground terminals includes a spring portion extending in the fitting portion and a free end portion extending from the spring portion and inserted into the space with being contacted with the protecting portion.

10 Claims, 3 Drawing Sheets

CONNECTOR WITH PROTECTION AGAINST ELECTROSTATIC CHARGES ACCUMULATED ON A MATING CONNECTOR

This application claims priority to prior Japanese patent application JP 2005-352120, the disclosure of which is incorporated herein by reference.

BACKGROUND OF THE INVENTION

This invention relates to a connector adaptable to high-speed transmission.

A connector of the type is required to have a so-called shielding function. For this purpose, a connector disclosed in Japanese Unexamined Patent Application Publication (JP-A) No. H11-283710 comprises, in addition to a signal contact for connecting a signal line, a ground contact for connecting a ground line. The signal contact and the ground contact are held by a housing defining a fitting portion to be fitted to a mating connector. A conductive shell is coupled to an outer surface of the housing. The ground contact has a spring portion disposed in the fitting portion. The spring portion has an end formed as a free end completely separated and apart from the shell.

When the mating connector is fitted to the fitting portion, the mating connector is contacted with the signal contact and the ground contact. As a result, the signal line and the ground line are connected via the mating connector to the signal contact and the ground contact, respectively.

The mating connector starts to contact with the signal contact and the ground contact in the middle of a fitting operation of the mating connector. Therefore, if the mating connector carries electrostatic charges, charge current may flow from the mating connector to the signal contact in the middle of the fitting operation. In case where the signal contact and the ground contact are preliminarily connected to an electric circuit, the charge current flow through the signal contact to the electric circuit. This may result in a damage of the electric circuit.

SUMMARY OF THE INVENTION

It is therefore an object of this invention to provide a connector having a structure in which, in the middle of a fitting operation of a mating connector, the mating connector is electrically connected to a ground contact before it is contacted with a signal contact.

It is another object of this invention to provide a connector which can be designed to be small in thickness.

It is still another object of this invention to provide a connector which allows a wide displacement of a spring portion of a ground contact.

Other objects of the present invention will become clear as the description proceeds.

According to an aspect of the present invention, there is provide a connector comprising a fitting portion to be fitted to a mating connector in a first direction, a plurality of signal contacts disposed in the fitting portion in a first row extending in a second direction perpendicular to the first direction, a ground plate including a plurality of ground terminals disposed in the fitting portion in a second row parallel to the first row, a housing holding the signal contacts and the ground plate, and a conductive shell coupled to the housing, the shell comprising a shell body partially covering the signal contacts and the ground plate, a bent portion formed at an end of the fitting portion and bent inward from the shell body, and a protecting portion extending from the bent portion along the shell body with a space which is kept between the protecting portion and the shell body in a third direction perpendicular to the first and the second directions, each of the ground terminals including a spring portion extending in the fitting portion along the shell body and a free end portion extending from the spring portion, inserted into the space, and contacted with the protecting portion.

DESCRIPTION OF THE PREFERRED EMBODIMENT

Figure 1A:
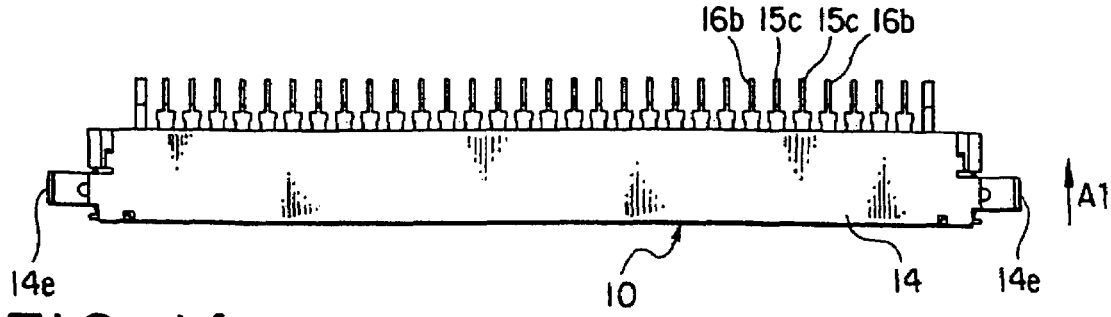
FIGS. 1A to 1D are a plan view, a front view, a bottom view, and a right side view of a connector according to an embodiment of this invention, respectively.
Figure 1B:
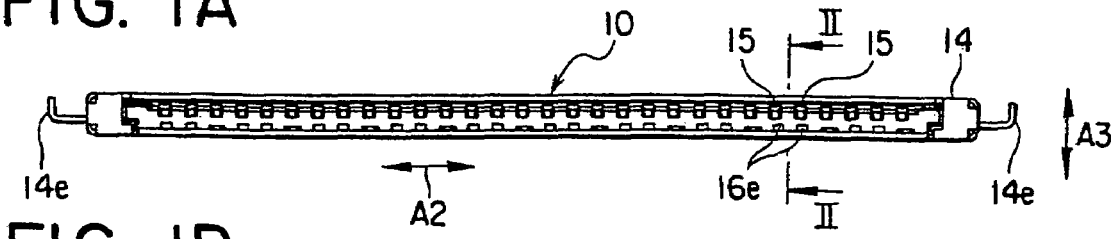
Figure 1C:
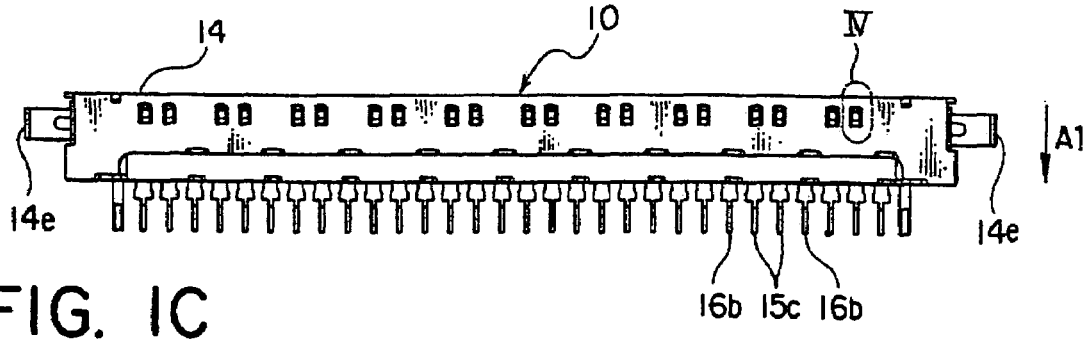
Figure 1D:
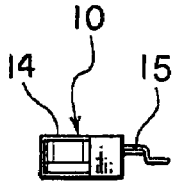

At first referring to FIGS. 1A to 1D and 2, description will be made of an overall structure of a connector according to an embodiment of this invention.

The connector illustrated in the figures is a socket connector and depicted by a reference numeral 10. The socket connector 10 has a fitting portion 11 to be fitted to a mating connector, i.e., a plug connector (not shown) which is inserted to in a first direction A1 as a fitting direction. The socket connector 10 has a connecting portion 12 formed at its rear end to be soldered to a circuit board (not shown). Hereinafter, for convenience of description, one side of the socket connector 10, i.e., the side of the fitting portion 11 will be called a front side and another side of the socket connector 10, i.e., the side of the connecting portion 12 will be called a rear side.

Figure 4:
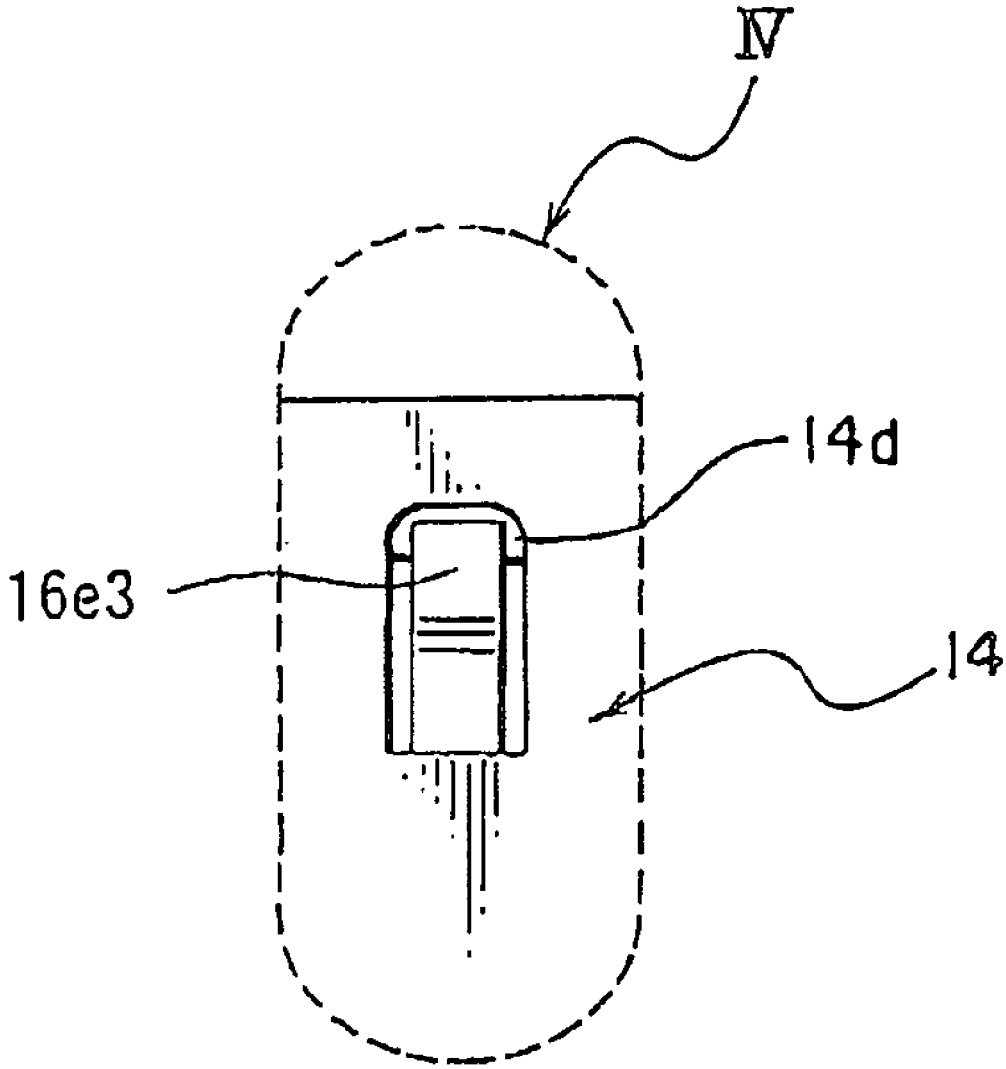
FIG. 4 is an enlarged view of a part IV in FIG. 1C.

The socket connector 10 comprises an insulator 13 serving as a housing having an L-shaped section, a conductive shell 14 formed around the insulator 13 and defining an outer contour of the socket connector 10, a plurality of conductive signal contacts 15 implanted on the insulator 13, and a conductive ground plate 16 formed by punching and press-forming a single conductive plate as shown in FIG. 4.

The insulator 13 has a ceiling plate 13*a* and a bottom plate 13*b* formed adjacent the rear end of the socket connector 10 and integrally connected to the ceiling plate 13*a*. The signal contacts 15 are implanted between the ceiling plate 13*a* and the bottom plate 13*b*. The ground plate 16 is inserted between the ceiling plate 13*a* and the bottom plate 13*b* in a direction opposite to the first direction A1 so as not to be contacted with the signal contacts 15.

The shell 14 has a box-like shape and has an opening 14*f* formed its front end. The shell 14 comprises a top plate 14*a* covering the insulator 13 and a bottom plate 14*b* opposite to the top plate 14*a*. The shell 14 electrically has a ground function. A combination of the top plate 14*a* and the bottom plate 14*b* forms a shell body partially covering the signal contacts 15 and the ground plate 16.

The shell 14 further comprises a bent portion 14*c* formed at the front end and bent inward and upward from the bottom plate 14*b*, and a protecting portion 14*d* extending from the bent portion 14*c* along the bottom plate 14*b* with a space which is kept between the protecting portion 14*d* and the bottom plate 14*b*. The bent portion 14*c* is gently curved or rounded to guide the mating connector to the fitting portion 11. The bent portion 14*c* serves to increase a mechanical strength of a front end portion of the socket connector 10.

The shell 14 further comprises a pair of substrate fixing portions 14*e* formed at opposite ends thereof in a second direction A2 perpendicular to the first direction A1 and protruding in a U shape. The substrate fixing portions 14*e* serve as solder fixing portions to the circuit board.

The signal contacts 15 are arranged in the fitting portion 11 in a first row extending in the second direction A2. Each of the signal contacts 15 has spring elasticity and has a thin, long plate-like shape adapted to impedance matching. Each of the signal contacts 15 has a contacting portion 15*a* having one end received in the fitting portion 11 and bent in an angled shape to be contacted with a mating contact, a supporting portion 15*b* extending from the contacting portion 15*a* rearward of the socket connector 10 and fixed and supported by the insulator 13, and a soldering terminal portion 15*c* extending from the supporting portion 15*b* rearward and outward of the socket connector 10 in the first direction A1, bent downward to extend in a third direction A3 perpendicular to the first and the second directions A1 and A2, further bent in the first direction A1, and horizontally extending to be soldered to the circuit board. Thus, the signal contact 15 has a plate-like simple structure and, therefore, can easily be impedance-matched.

Figure 2:
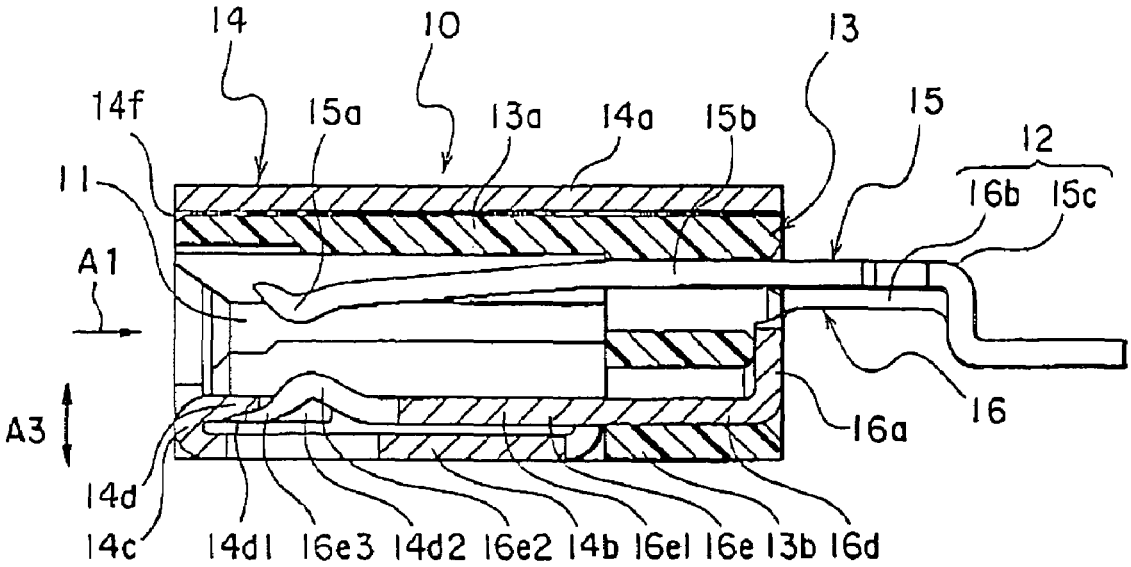
FIG. 2 is a sectional view taken along a line II-II in FIG. 1B.
Figure 3:
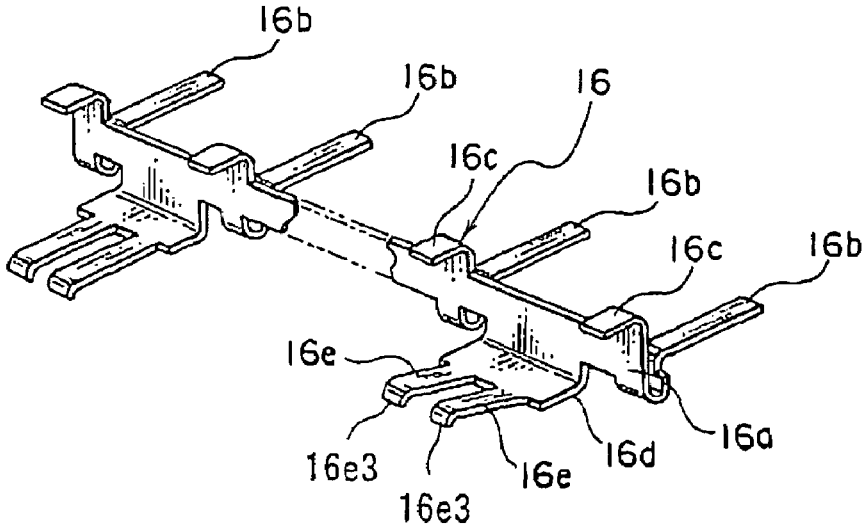
FIG. 3 is a perspective view of a ground contact of a connector illustrated in FIGS. 1A to 1D.

Referring to FIG. 3 in addition to FIG. 2, the ground plate 16 will be described.

The ground plate 16 has a connecting portion 16*a* extending in the second direction A2, a plurality of connecting terminals or soldering terminal portions 16*b* bent from the connecting portion 16*a* and extending rearward, a plurality of fixing portions 16*c* formed at positions corresponding to the soldering terminal portions 16*b*, extending upward from the connecting portion 16*a* and bent frontward to be fixed to the insulator 13, a plurality of contact base portions 16*d* having spring elasticity and formed at positions between adjacent ones of the soldering terminal portions 16*b* on the side opposite to the soldering terminal portions 16*b*, and a plurality of pairs of ground terminals 16*e*, each pair extending frontward from each contact base portion 16*d*. The connecting portion 16*a* is held by the insulator 13. The soldering terminal portions 16*b* are exposed outside of the insulator 13 as connecting terminals.

Each of the ground terminals 16*e* has a spring portion 16*e*1 extending in the fitting portion 11 along the bottom plate 14*b* of the shell 14, a contacting portion 16*e*2 disposed in the fitting portion 11 and faced to the contacting portion 15*a* of the signal contact 15 in the third direction A3, and a free end portion 16*e*3 extending from the spring portion 16*e*1 and inserted into a space between the bottom plate 14*b* and the protecting portion 14*d*. The free end portion 16*e*3 is urged by elastic restoring force of the spring portion 16*e*1 to be brought into contact with the protecting portion 14*d*. Therefore, in the state where the socket connector 10 is not fitted to the mating connector, the socket connector 10 is electrically connected to the ground plate 16. The ground terminals 16*e* are entirely disposed inside the shell body.

As described above, in the fitting portion 11, the contacting portions 16*e*2 of the ground terminals 16*e* are faced to the contacting portions 15*a* of the signal contacts 15 in the second direction A2, respectively. A pair of adjacent ones of the contacting portions 15*a* of the signal contacts 15 are used to transmit a pair of differential signals. Hereinafter, a pair of signal contacts 15 will be called a signal contact pair.

On the other hand, at the connecting portion 12 on the side opposite to the fitting portion 11 of the socket connector 10, the soldering terminal portions 15*c* of the signal contact pair are disposed between adjacent ones of the soldering terminal portions 16*b* of the ground plate 16. Thus, at the connecting portion 12 of the socket connector 10, the soldering terminal portions 16*b* of the ground plate 16 and the soldering terminal portions 15*c* of the signal contacts 15 are arranged on a same plane in a single row in the second direction A2. Therefore, it is easy to connect the soldering terminal portions 16*b* and the soldering terminal portions 15*c* to the circuit board, for example, by soldering.

At the connecting portion 12 of the socket connector 10, the soldering terminal portions 16*b* of the ground plate 16 are arranged adjacent to the soldering terminal portions 15*c* of the signal contact pair. Therefore, a pair of differential signals can be dealt with in a good condition.

Referring to FIG. 4 in addition to FIG. 2, description will be made of the protecting portion 14*d* and the free end portion 16*e*3 in detail.

The free end portion 16*e*3 is small in thickness in the third direction A3 as compared with the spring portion 16*e*1 and the contacting portion 16*e*2. The protecting portion 14*d* has a slope 14*d*1 for guiding insertion of the free end portion 16*e*3 into the space. Preferably, an upper surface of the free end portion 16*e*3 has an inclination equivalent to the slope 14*d*1 in order to widen a contact area between the protecting portion 14*d* and the free end portion 16*e*3. The protecting portion 14*d* is provided with a cut portion 14*d*2 for guiding and allowing vertical movement of the contacting portion 16*e*2 of the ground terminal 16*e*. Thus, the cut portion 14*d*2 protects the contacting portion 16*e*2 of the ground terminal 16*e*.

Next referring to FIG. 2, description will be made of connection of the socket connector 10 and the mating connector.

The mating connector is fitted to the fitting portion 11 of the socket connector 10 in the first direction A1. At the start of the fitting operation, the mating connector is guided by the curved bent portion 14*c* of the shell 14 in frictional contact therewith and is at first contacted with the protecting portion 14*d* of the shell 14. The ground plate 16 is electrically connected to the protecting portion 14*d* of the shell 14. Therefore, even if the mating connector carries electrostatic charges, charge current flows through the ground plate 16 and does not flow to the signal contacts 15. The free end portion 16*e*3 is hidden below the protecting portion 14*d*. Therefore, when the mating connector is fitted to the socket connector 10, the free end portion 16*e*3 is not pushed by the mating connector in the first direction A1. Therefore, the ground plate 16 is hardly pushed rearward of the socket connector 10.

When the mating connector is further moved in the first direction A1, the contacting portions 15*a* and 16*e*2 of the signal contact 15 and the ground terminal 16*e* are displaced away from each other by the mating connector. Since the free end portion 16*e*3 is small in thickness, the displacement of the contacting portion 16*e*2 of each ground terminal 16*e* can be increased.

When the mating connector is completely fitted to the fitting portion 11 of the socket connector 10, the contacting portion 15*a* of the signal contact 15 and the contacting portion 16*e*2 of the ground terminal 16*e* are contacted with the mating connector. Therefore, connection of the signal line and the ground line is achieved. Each component is designed so that an end portion of the ground terminal 16*e* does not protrude below a lower surface of the bottom plate 14*b* of the shell 14 upon fitting or in a fitted state.

While the present invention has thus far been described in connection with the preferred embodiment thereof, it will readily be possible for those skilled in the art to put this invention into practice in various other manners.

What is claimed is:

1. A connector comprising:

a fitting portion to be fitted to a mating connector in a first direction;

a plurality of signal contacts disposed in the fitting portion in a first row extending in a second direction perpendicular to the first direction;

a ground plate including a plurality of ground terminals disposed in the fitting portion in a second row parallel to the first row;

a housing holding the signal contacts and the ground plate; and a conductive shell coupled to the housing;

the shell comprising:

a shell body partially covering the signal contacts and the ground plate;

a bent portion formed at an end of the fitting portion and bent inward from the shell body; and a protecting portion extending from the bent portion along the shell body with a space which is kept between the protecting portion and the shell body in a third direction perpendicular to the first and the second directions;

each of the ground terminals including:

a spring portion extending in the fitting portion along the shell body; and a free end portion extending from the spring portion, inserted into the space, and contacted with the protecting portion.

2. The connector according to claim 1, wherein the free end portion is small in thickness in the third direction as compared with the spring portion.

3. The connector according to claim 1, wherein the ground terminals are entirely disposed inside the shell body.

4. The connector according to claim 1, wherein the protecting portion has a slope for guiding insertion of the free end portion into the space.

5. The connector according to claim 1, wherein the protecting portion has a cut portion formed at a position corresponding to each of the ground terminals to guide a part of the ground terminal near the free end portion.

6. The connector according to claim 1, wherein the ground plate further includes a connecting portion connecting the ground terminals to one another, the connecting portion being held by the housing.

7. The connector according to claim 6, wherein the ground plate has a plurality of connecting terminals extending from the connecting portion on the side opposite to the ground terminals, the connecting terminals being exposed outside the housing.

8. The connector according to claim 7, wherein each of the signal contacts extends on the side opposite to the fitting portion to be exposed outside and is disposed between adjacent ones of the connecting terminals.

9. The connector according to claim 1, wherein the signal contacts and the ground terminals have contacting portions faced to each other in the fitting portion.

10. The connector according to claim 4, wherein the slope slants to the shell body so as to expand the space while parting from the bent portion, and wherein the free end portion is in contact with the slope.

* * * * *